US011620930B2

(12) United States Patent
Wu et al.

(10) Patent No.: US 11,620,930 B2
(45) Date of Patent: Apr. 4, 2023

(54) DISPLAY DEVICE WITH SYSTEM-ON-CHIP INCLUDING OPTICAL PERFORMANCE ADJUSTMENT IP CORE

(71) Applicant: Xianyang Caihong Optoelectronics Technology Co., Ltd, Xianyang (CN)

(72) Inventors: Yuan-Liang Wu, Xianyang (CN); Yu-Yeh Chen, Xianyang (CN); Lei Sun, Xianyang (CN); Zihan Liu, Xianyang (CN); Jun Shi, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 17/553,177

(22) Filed: Dec. 16, 2021

(65) Prior Publication Data

US 2022/0108647 A1 Apr. 7, 2022

Related U.S. Application Data

(63) Continuation of application No. PCT/CN2019/097161, filed on Jul. 22, 2019.

(30) Foreign Application Priority Data

Jun. 25, 2019 (CN) ..... 2019105572724

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01);
(Continued)

(58) Field of Classification Search
CPC ..... G09G 3/20; G09G 2310/08; G09G 2310/027; G09G 2310/0267; G09G 2320/0242
See application file for complete search history.

(56) References Cited

U.S. PATENT DOCUMENTS

2012/0327054 A1* 12/2012 Zhao ..... G09G 3/3611 345/87
2014/0089697 A1* 3/2014 Kim ..... G06F 1/3296 713/320
(Continued)

*Primary Examiner* — Gerald Johnson
(74) *Attorney, Agent, or Firm* — WPAT, PC

(57) ABSTRACT

A display device is provided and includes: a display panel, disposed with a gate driving circuit and a source driving circuit; a X-board, disposed with a driving circuit board assembly including a display control circuit and a first connector, the display control circuit is connected with the gate driving circuit, the source driving circuit and the first connector; a system board, disposed with a second connector and a system-on-chip (SOC) connected to the second connector, the SOC includes an optical performance adjustment intellectual property core; and a connecting part, connected between the first connector and the second connector. By disposing the driving circuit board assembly on the X-board to make the X-board have some of TCON functions, completely independent of the SOC when debugging and changing Panel Timing, and can be developed independently, panel manufacturers can complete the panel debugging and changing independently without relying on changing the SOC.

9 Claims, 3 Drawing Sheets

(52) U.S. Cl.
CPC . *G09G 2310/08* (2013.01); *G09G 2320/0242* (2013.01); *G09G 2320/0673* (2013.01)

(56) References Cited

U.S. PATENT DOCUMENTS

| | | | | |
|---|---|---|---|---|
| 2018/0210261 | A1* | 7/2018 | Chen | G02F 1/13452 |
| 2018/0308440 | A1* | 10/2018 | Huang | G09G 3/3648 |
| 2019/0088231 | A1* | 3/2019 | Zhao | G09G 3/3696 |

* cited by examiner

DISPLAY DEVICE WITH SYSTEM-ON-CHIP INCLUDING OPTICAL PERFORMANCE ADJUSTMENT IP CORE

TECHNICAL FIELD

The invention relates to the field of display technologies, in particular to a display device with system-on-chip including optical performance adjustment IP core.

BACKGROUND

A conventional display device mainly includes a system-on-chip (SOC) disposed on a system board (also referred to as mainboard or motherboard), a timing controller (TCON) board, a horizontal direction circuit board (X-board, XB), a source driving circuit and a gate driving circuit. The SOC receives and outputs an image data signal to be transmitted, subsequently processes an input signal through a row expansion module and a column expansion module to obtain a processed data, and transmits the processed data to the TCON board, the TCON board transmits the processed data (also referred to as received data) to the source driving circuit and the gate driving circuit through the X-board, so as to drive a thin film transistor liquid crystal display for display.

At present, a flexible flat cable (FFC) is usually used to connect the system board and the horizontal direction circuit board for signal transmission between them. However, since the functions of TCON IC is integrated in the SOC on the system board, cooperation of the SOC is required when debugging and changing a panel. Since the operation of TCON needs to depend on the SOC, the TCON cannot be developed independently.

SUMMARY

In order to solve the above problems existing in the prior art, the invention provides a display device. The technical problem to be solved by the invention is realized by the following technical scheme:

a display device, including:

a display panel, disposed with a gate driving circuit and a source driving circuit;

a horizontal direction circuit board (X-board), disposed with a driving circuit board assembly; the driving circuit board assembly includes a display control circuit and a first connector, and the display control circuit is connected with the gate driving circuit, the source driving circuit and the first connector;

a system board, disposed with a second connector and a system-on-chip connected to the second connector; the system-on-chip includes an optical performance adjustment intellectual property (IP) core; and a connecting part, connected between the first connector and the second connector.

In an embodiment, the X-board includes at least two circuit sub-boards juxtaposed with each other, the driving circuit board assembly is disposed on one of the at least two circuit sub-boards, and adjacent two circuit sub-boards of the at least two circuit sub-boards form an electrical connection through another connecting part connected between connectors respectively disposed on the adjacent two circuit sub-boards.

In an embodiment, the X-board is further disposed with a plurality of mini low voltage differential signaling (Mini-LVDS) interfaces, the first connector includes a point-to-point (P2P) interface, and the display control circuit includes a signal conversion circuit; the signal conversion circuit is electrically connected to the first connector and the plurality of Mini-LVDS interfaces and configured to receive a P2P interface signal containing image data through the first connector, generate source control signals and second interface type image data signals according to the P2P interface signal, and output the source control signals and the second interface type image data signals to the source driving circuit through the plurality of Mini-LVDS interfaces; wherein the second interface type image data signals are Mini-LVDS interface signals.

In an embodiment, the display control circuit further includes a level conversion circuit and a direct-current (DC) voltage conversion circuit; and the DC voltage conversion circuit is electrically connected to the first connector and configured to receive an input DC voltage through the first connector, generate gate switching voltages according to the input DC voltage, and output the gate switching voltages to the level conversion circuit; the level conversion circuit is electrically connected to the first connector and configured to receive reference timing signals through the first connector, generate gate control signals according to the reference timing signals and the gate switching voltages, and output the gate control signals to the gate driving circuit.

In an embodiment, an integration manner of the DC voltage conversion circuit, the level conversion circuit and the signal conversion circuit is one selected from the group consisting of: the DC voltage conversion circuit, the level conversion circuit and the signal conversion circuit are integrated into a same chip; the DC voltage conversion circuit and the level conversion circuit are integrated into a same chip, and the signal conversion circuit is integrated into another chip; the DC voltage conversion circuit and the signal conversion circuit are integrated into a same chip and the level conversion circuit is integrated into another chip; the level conversion circuit and the signal conversion circuit are integrated into a same chip and the DC voltage conversion circuit is integrated into another chip; and the DC voltage conversion circuit, the level conversion circuit and the signal conversion circuit are respectively integrated into different chips.

In an embodiment, the display control circuit further includes a level conversion circuit, a direct-current (DC) voltage conversion circuit and a Gamma correction circuit; and the DC voltage conversion circuit is electrically connected to the first connector and configured to receive an input DC voltage through the first connector, generate gate switching voltages and a reference voltage according to the input DC voltage, and output the gate switching voltages and the reference voltage to the level conversion circuit and the Gamma correction circuit respectively; the level conversion circuit is electrically connected to the first connector, and configured to receive reference timing signals through the first connector, generate gate control signals according to the reference timing signals and the gate switching voltages, and output the gate control signals to the gate driving circuit; and the Gamma correction circuit is configured to generate a plurality of Gamma voltages according to the reference voltage and output the plurality of Gamma voltages to the source driving circuit.

In an embodiment, the X-board is further disposed with a nonvolatile memory electrically connected to the first connector; the nonvolatile memory stores an optical performance adjustment parameter table; and the system-on-chip is configured to read the optical performance adjustment parameter table stored in the nonvolatile memory through the second connector, the connecting part and the first connector and load the optical performance adjustment parameter table into the optical performance adjustment IP core.

In an embodiment, the optical performance adjustment IP core includes one or more selected from the group consisting of a Demura IP core, a white balance adjustment IP core, a color shift compensation IP core, an OverDrive IP core and a dithering processing IP core; and the optical performance adjustment parameter table correspondingly includes one or more selected from the group consisting of a Demura parameter table, a white balance adjustment parameter table, a color shift compensation parameter table, an OverDrive parameter table and a dithering processing parameter table.

In an embodiment, the optical performance adjustment IP core includes the Demura IP core, the white balance adjustment IP core, the color shift compensation IP core, the OverDrive IP core and the dithering processing IP core; the system-on-chip is configured to sequentially control the Demura IP core, the white balance adjustment IP core, the color shift compensation IP core, the OverDrive IP core and the dithering processing IP core to perform a Demura operation, a white balance adjustment, a color shift compensation operation, an OverDrive operation and a dithering processing operation according to the Demura parameter table, the white balance adjustment parameter table, the color shift compensation parameter table, the OverDrive parameter table and the dithering processing parameter table respectively.

Compared with the prior art, the above embodiments have one or more of the following advantages or beneficial effects:

1. The display device of the embodiment disposes the driving circuit board assembly on the X-board, so that the X-board has some of TCON functions. When debugging and changing Panel Timing, it does not depend on the SOC and can be developed independently. Through the architecture adjustment of the embodiment, the system board (also referred to as mainboard, shorted as MB) and the horizontal direction circuit board (XB) can be manufactured and sold separately, the panel manufacturer can debug and change the panel independently without relying on changing the SOC.

2. The display device of the embodiment adds the signal conversion circuit (for example, in the form of a chip) in the display control circuit of the driving circuit board assembly. On the one hand, it converts the P2P interface signal into the mini-LVDS interface signal, so that the interface between a COF type source driver of the source driving circuit and the driving circuit board assembly is changed into the mini-LVDS interface, which greatly reduces the cost; on the other hand, the signal conversion circuit can generate the timing control signals required by the display panel, the debugging and revision of the panel can be completed by the panel manufacturer, and the whole machine manufacturer can reduce the development cost without any change; on the other hand, new panel technology can be completed by the signal conversion circuit, and the system board does not need any change.

3. The display device of the embodiment stores the optical performance adjustment parameters in the nonvolatile memory of the X-board in the form of the parameter table, and debugging of each parameter in the optical performance adjustment parameter table is changed from the whole machine manufacturer to the panel manufacturer; because the optical performance adjustment parameters are strongly related to the panel, the optical performance adjustment parameter tables required for different panels are different, and the panel manufacturers know more about the optical characteristics of their own panels. Therefore, they can flexibly adjust the panel optical characteristics according to their own panel characteristics, which can liberate the whole machine manufacturers from the tedious work of adjusting optical characteristics, so as to accelerate the development speed of the whole machine.

The invention will be further described in detail below in combination with the accompanying drawings and embodiments.

DETAILED DESCRIPTION OF THE EMBODIMENTS

The invention is described in further detail below in combination with exemplary embodiments, but the embodiments of the invention are not limited to this.

Figure 1:
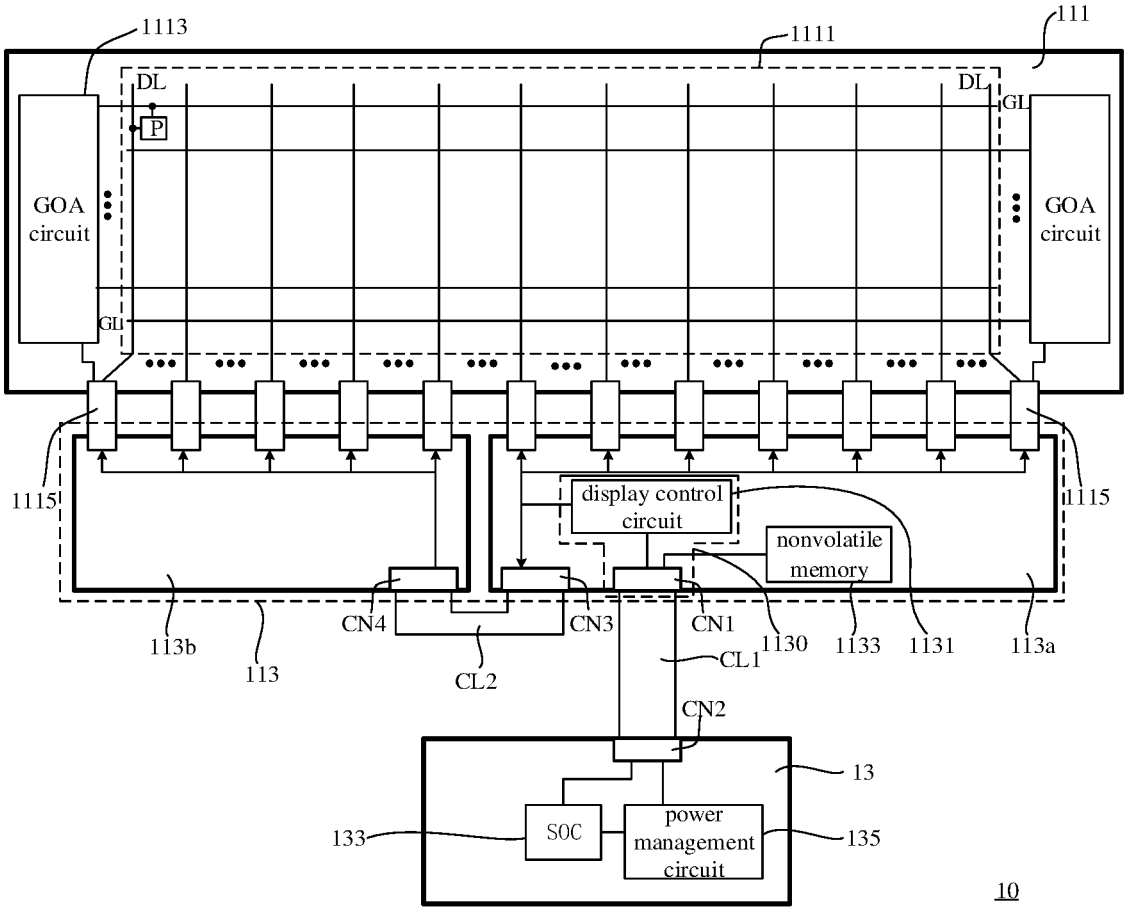
FIG. 1 is a schematic structural view of a display device according to an embodiment of the invention.

As shown in FIG. 1, a display device 10 provided by an embodiment of the invention includes: a display panel 111, a X-board 113, a system board 13 and a connecting part (also referred to as connecting member) CL1. The display panel 111 is disposed with a gate driving circuit and a source driving circuit. The X-board 113 is disposed with a driving circuit board assembly 1130. The display device 10 is an active-matrix display device in the illustrated embodiment, for example, a TCONLESS liquid crystal television (LCD TV). A system-on-chip (SOC) disposed on the system board 13 integrates at least part of functions of traditional TCON chip, and the X-board integrates at least another part of the functions of the traditional TCON chip, but the embodiment of the invention is not limited to this. Therefore, the SOC is a chip but not the traditional TCON chip, and moreover the SOC can provide other functions such as an audio processing function besides the function of receiving image data signal for video processing.

The display panel 111 includes a display area 1111, a gate driving circuit electrically connected to the display area 1111 and a source driving circuit electrically connected to the display area 1111. The display area 1111 is disposed with a plurality of data lines DL, a plurality of gate lines GL and a plurality of pixels P respectively electrically connected to corresponding one of plurality of data lines DL and corresponding one of the plurality of gate lines GL. Each of the plurality of pixels P is located at the intersection of the corresponding gate line GL and the corresponding data line DL. The gate driving circuit includes, for example, two GOA (gate on array, gate driving circuit integrated on the array substrate) circuits 1113, which are located on the peripheral area of the display area 1111 and are divided on opposite sides of the display area 1111, that is, the gate driving circuit of the display panel 111 is a bilateral GOA circuit. The GOA circuit 1113 is electrically connected to the gate lines GL in the display area 1111 to provide gate driving signals to each of the plurality of gate lines GL in the display area 1111. The source driving circuit includes, for example, a plurality of chip-on-flex (COF) type source drivers 1115, such as twelve COF type source drivers 1115 shown in FIG. 1. The COF type source driver 1115 is electrically connected to the corresponding data line DL in the display area 1111 and configured to provide an image data signal to each of the plurality of data lines DL. More specifically, one of the plurality of COF type source drivers 1115 includes, for example, a flexible circuit board and a source driver IC disposed on the flexible circuit board.

The X-board 113 can be a whole independent circuit board or a plurality of circuit sub-boards juxtaposed with each other. If it is the plurality of circuit sub-boards juxtaposed with each other, the driving circuit board assembly 1130 can be disposed on one of the plurality of circuit sub-boards, and adjacent two circuit sub-boards of the plurality of circuit sub-boards form an electrical connection through another connecting part connected between connectors respectively disposed on the adjacent two circuit sub-boards.

The embodiment is described with two circuit sub-boards. The X-board 113 includes two circuit sub-boards 113*a* and 113*b*, which are arranged on one side of the display panel 111 along the horizontal direction of FIG. 1, that is, as a driving circuit board in the row direction; one side of each of the circuit sub-boards 113*a* and 113*b* adjacent to the display area 1111 is provided with a connection interface of the COF type source driver 1115, such as a mini-LVDS interface. As described above, the driving circuit board assembly 1130 is disposed on the circuit sub-board 113*a*, specifically, the circuit sub-board 113*a* is provided with a display control circuit 1131, a connector CN1, a nonvolatile memory 1133 and a connector CN3. The circuit sub-board 113*a* is electrically connected to the display area 1111 through a plurality of COF type source drivers 1115, for example, seven COF type source drivers 1115, and electrically connected to the GOA circuit 1113 on the right side of the display panel 111 using the rightmost COF type source driver 1115. The circuit sub-board 113*b* is provided with a connector CN4. The circuit sub-board 113*b* is electrically connected to the display area 1111 through a plurality of COF type source drivers 1115, for example, five COF type source drivers 1115, and electrically connected to the GOA circuit 1113 on the left side of the display panel 111 using the leftmost COF type source driver 1115. An electrical connection is formed between the connector CN3 of the circuit sub-board 113*a* and the connector CN4 of the circuit sub-board 113*b* through the connecting part CL2, the connecting part CL2 is, for example, a flexible circuit board or flexible flat cable (FFC), so that the signal generated from the circuit sub-board 113*a* is transmitted to the circuit sub-board 113*b* through the connecting part CL2.

Figure 2:
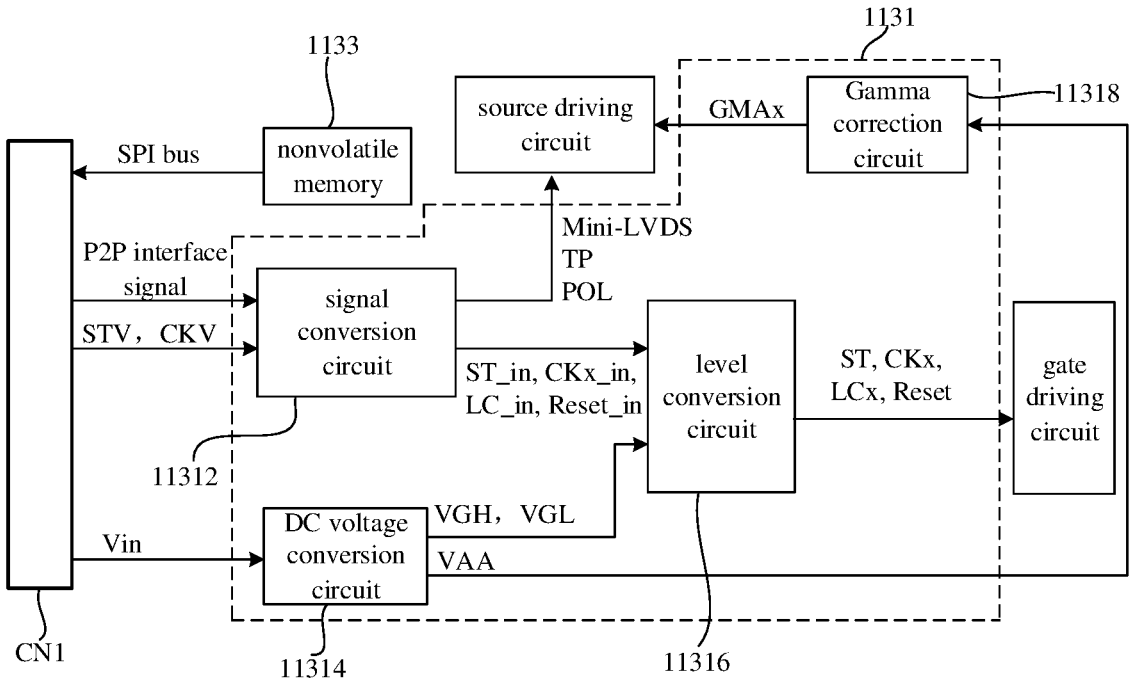
FIG. 2 is a schematic structural view of the display control circuit of the display device shown in FIG. 1.

Further, the display control circuit 1131 is electrically connected to the first connector CN1, the connector CN3 and a plurality of COF type source drivers 1115, for example, seven COF type source drivers 1115. In this way, the display control circuit 1131 is not only electrically connected to the seven COF type source drivers 1115 on the right through a printed circuit board (PCB) of the circuit sub-board 113*a*, but also connected to the five COF type source drivers 1115 on the left through the connector CN3, the connecting part CL2, the connector CN4 and the PCB of the circuit sub-board 113*b*. The X-board 113 is also provided with a plurality of mini low voltage differential signaling (Mini-LVDS) interfaces, which are arranged between the COF type source drivers 1115 and the display control circuit 1131, and the first connector includes a point-to-point (P2P) interface. Referring to FIG. 2, the display control circuit 1131 includes a signal conversion circuit 11312, which is electrically connected with the first connector CN1 and the Mini-LVDS interface, and is configured to receive a P2P interface signal containing image data through the first connector, generate source control signals and second interface type image data signals according to the P2P interface signal, and output the source control signals and the second interface type image data signals to the source driving circuit through the plurality of Mini-LVDS interfaces; the second interface type image data signals are Mini-LVDS interface signals.

It should be noted that in the prior art, in order to match the signal sent by the SOC, the interface of the source driver needs to be adjusted accordingly. For example, if the signal sent by the SOC is transmitted through the P2P interface, the corresponding source driver interface can only use the P2P interface, resulting in an increase in the overall manufacturing cost and test cost. In this embodiment, if the connector CL1 transmits the signal from the SOC to the signal conversion circuit 11312 of the display control circuit 1131 through the P2P interface, the signal conversion circuit 11312 can convert the P2P interface signal into an interface signal corresponding to the panel source driver. For example, the interface of the COF type source driver 1115 is the Mini-LVDS interface, the P2P interface signal is correspondingly converted into the Mini-LVDS signal by the signal conversion circuit, and the Mini-LVDS signal is sent to the interface of the COF type source driver 1115 of the panel, that is, the conversion of the interface signal is completed through the signal conversion circuit 11312, so as to complete the data transmission without changing the original Mini-LVDS interface on the panel. By adding the signal conversion circuit (for example, in the form of a chip) in the display control circuit of the driving circuit board assembly. On the one hand, it converts the P2P interface signal into the mini-LVDS interface signal, so that the interface between the COF type source driver 1115 of the source driving circuit and the interface of the X-board is changed into the Mini-LVDS interface, which greatly reduces the cost; on the other hand, the signal conversion circuit 11312 can generate the timing control signals required by the display panel, the debugging and revision of the panel can be completed by the panel manufacturer, and the whole machine manufacturer can reduce the development cost without any change; on the other hand, new panel technology can be completed by the signal conversion circuit 11312, and the system board 13 does not need any change.

On the other hand, the display control circuit 1131 further includes a direct-current (DC) voltage conversion circuit 11314, a level conversion circuit 11316 and a Gamma correction circuit 11318. The signal conversion circuit 11312 is electrically connected to the connector CN1, the level conversion circuit 11316 and the source driving circuit, and configured to receive reference timing signals such as STV and CKV and a P2P interface signal containing image data (the image data such as RGB data) through the first connector, generate source control signals such as TP and POL and second interface type image data signals such as Mini-LVDS according to the P2P interface signal, and output them to the source driving circuit, and generate initial gate control signals such as ST_in, CKx_in, LC_in and Reset_in according to the reference timing signals such as STV and CKV to the level conversion circuit 11316. The DC voltage conversion circuit 11314 is electrically connected to the connector CN1 and configured to receive an input DC voltage such as Vin, and generate gate switching voltages such as VGH and VGL and a reference voltage such as VAA according to the input DC voltage such as Vin, and output the gate switching voltages and the reference voltage to the level conversion circuit 11316 and the Gamma correction circuit 11318 respectively. The level conversion circuit 11316 is configured to generate gate control signals such as ST, CKx, LCx and Reset according to the gate switching voltages such as VGH and VGL and the initial gate control signal such as ST_jn, CKx_in, LC_in, Reset_in to the gate driving circuit. The Gamma correction circuit 11318 is configured to generate a plurality of Gamma voltages such as GMAx according to the reference voltage such as VAA to the source driving circuit. In an illustrated example, CKx_in is, for example, four high-frequency clock signals CK1~CK4, CKx is, for example, eight high-frequency clock signals CK1~CK8, and LCx is two low-frequency clock signals LC1~LC2 relative to CKx, GMAx is, for example, fourteen channel Gamma voltages such as GMA1~GMA14, VGH is, for example, +20V~+30V as the gate on voltage, and VGL is, for example, about −5V as the gate off voltage, but this invention is not limited thereto. In addition, it is worth noting that the P2P interface signal includes multiple pairs of differential signals, which is another interface type different from the Mini-LVDS interface, and is very suitable for short-distance signal transmission from the system board 13 to the circuit sub-board 113*a*, which can be known mature USI-T, EPI, CMPI and ISP interface, etc. In addition, it should be noted that the DC voltage conversion circuit 11314 is not limited to generating the above VGH, VGL and VAA, but is also used to provide power supply voltages such as digital voltage VDD and analog voltage HVAA (not shown in the figure) to the signal conversion circuit 11312, the level conversion circuit 11316, the Gamma correction circuit 11318, the gate driving circuit and the source driving circuit.

As described above, the signal conversion circuit 11312, the DC voltage conversion circuit 11314, the level conversion circuit 11316 and the Gamma correction circuit 11318 in the embodiment shown in FIG. 2 are integrated into four different chips, for example. For example, the DC voltage conversion circuit 11314 adopts a PMIC chip of known mature technology, the level conversion circuit 11316 adopts a level shift chip of known mature technology, and the Gamma correction circuit 11318 adopts a P-Gamma chip of known mature technology. In addition, in order to further improve the integration of the circuit, in other embodiments, the DC voltage conversion circuit 11314 and the level conversion circuit 11316 can be integrated on the same chip and the Gamma correction circuit 11318 can be integrated on another chip; or the DC voltage conversion circuit 11314 and the Gamma correction circuit 11318 can be integrated on the same chip and the level conversion circuit 11316 can be integrated on another chip; or the level conversion circuit 11316 and the Gamma correction circuit 11318 can be integrated on the same chip, and the DC voltage conversion circuit 11314 can be integrated on the same chip; or even the DC voltage conversion circuit 11314, the level conversion circuit 11316 and the Gamma correction circuit 11318 can be integrated on the same chip.

In the prior art, since the functions of TCON IC are integrated in the SOC on the system board, SOC cooperation is required when debugging and changing Panel Timing. However, some functions of TCON IC in the embodiment are set on the X-board. When debugging and changing Panel Timing, it does not depend on the SOC at all and can be developed independently. Through the architecture adjustment of this embodiment, the system board and the X-board can be manufactured and sold separately, and the panel manufacturer can complete the panel debugging and change independently without relying on the change of SOC.

When the display control circuit 1131 includes the Gamma correction circuit 11318, since the Gamma correction circuit 11318 is disposed on the X-board, the gamma curve can be adjusted piece by piece. In addition, a power management circuit 135 can also be disposed on the X-board, and the power management circuit 135 is connected to the display control circuit 1131, so that panel manufacturers can adjust and revise the power supply part by themselves during panel manufacturing.

Of course, the display control circuit 1131 cannot include one or more selected from the group consisting of the DC voltage conversion circuit 11314, the level conversion circuit 11316 and the Gamma correction circuit 11318. For example, when the Gamma correction circuit 11318 is not included, the DC voltage conversion circuit 11314, the level conversion circuit 11316 and the signal conversion circuit 11312 can be integrated into the same chip; alternatively, the DC voltage conversion circuit 11314 and the level conversion circuit 11316 can be integrated on the same chip, and the signal conversion circuit 11312 can be integrated on another chip; alternatively, the DC voltage conversion circuit 11314 and the signal conversion circuit 11312 can be integrated on the same chip, and the level conversion circuit 11316 can be integrated on another chip; alternatively, the level conversion circuit 11316 and the signal conversion circuit 11312 can be integrated on the same chip, and the DC voltage conversion circuit 11314 can be integrated on another chip; alternatively, the DC voltage conversion circuit 11314, the level conversion circuit 11316 and the signal conversion circuit 11312 can be integrated on the same chip.

Figure 3:
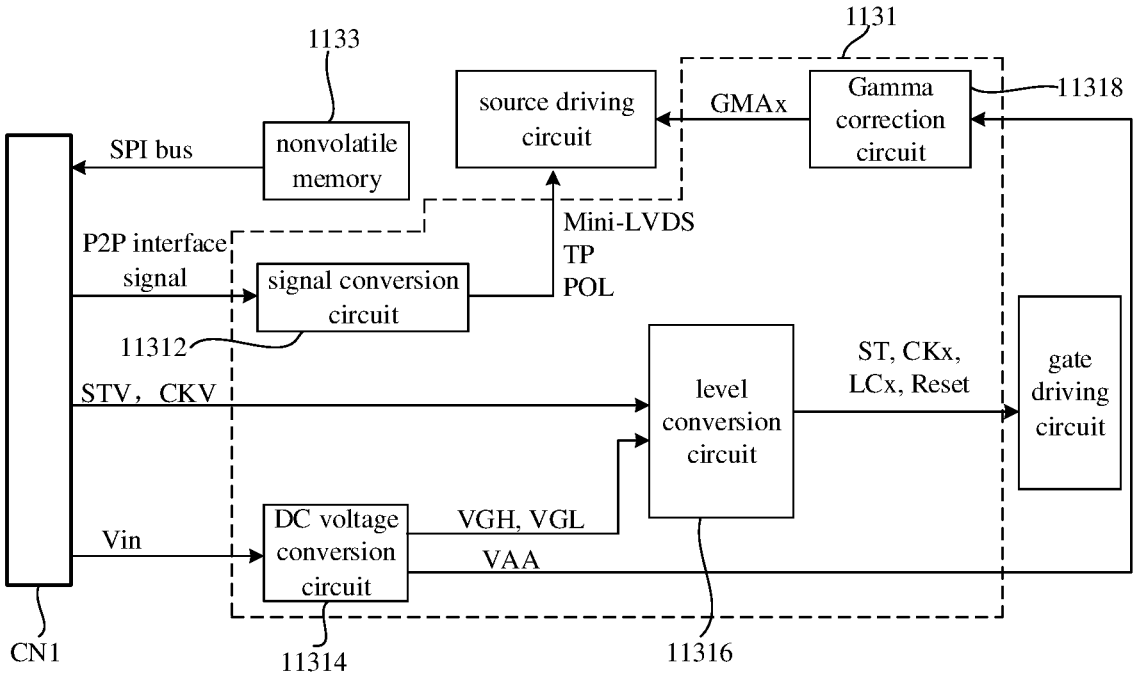
FIG. 3 is another schematic structural view of the display control circuit of the display device shown in FIG. 1.

As shown in FIG. 3, in another embodiment, the display control circuit 1131 includes a signal conversion circuit 11312, a DC voltage conversion circuit 11314, a level conversion circuit 11316 and a Gamma correction circuit 11318. The signal conversion circuit 11312 is electrically connected to the connector CN1 and the source driving circuit and configured to receive the P2P interface signal containing image data through the connector CN1, generate source control signals such as TP and POL and second interface type image data signals such as Mini-LVDS according to the P2P interface signal, and output them to the source driving circuit. The DC voltage conversion circuit 11314 is electrically connected to the connector CN1 and configured to receive an input DC voltage such as Vin through the connector CN1, and generate gate switching voltages such as VGH and VGL and a reference voltage such as VAA according to the input DC voltage such as Vin, and output the gate switching voltages and the reference voltage to the level conversion circuit 11316 and the Gamma correction circuit 11318 respectively. The level conversion circuit 11316 is electrically connected to the connector CN1 and configured to receive the reference timing signals such as STV and CKV, generate gate control signals such as ST, CKx, LCx and Reset according to the reference timing signals such as STV and CKV and the gate switching voltages such as VGH and VGL to the gate driving circuit. The Gamma correction circuit 11318 is configured to generate a plurality of Gamma voltages such as GMAx according to the reference voltage such as VAA to the source driving circuit. In short, the main difference between the embodiment shown in FIG. 3 and the embodiment shown in FIG. 2 is that the reference timing signals such as STV and CKV in the embodiment shown in FIG. 3 are directly sent to the level conversion circuit 11316, rather than initially converted through the signal conversion circuit 11312 and then sent to the level conversion circuit 11316 as shown in FIG. 2. Alternatively, in other embodiments, the reference timing signals such as STV and CKV can also be generated locally by the signal conversion circuit 11312 rather than directly provided by the system board 13.

In addition, the display control circuit 1131 can be further electrically connected (not shown in FIG. 1) to the nonvolatile memory 1133, for example, connected to the same serial bus as the nonvolatile memory, such as SPI (serial peripheral interface) bus; SPI bus has the advantage of fast data reading and writing speed.

Figure 4:
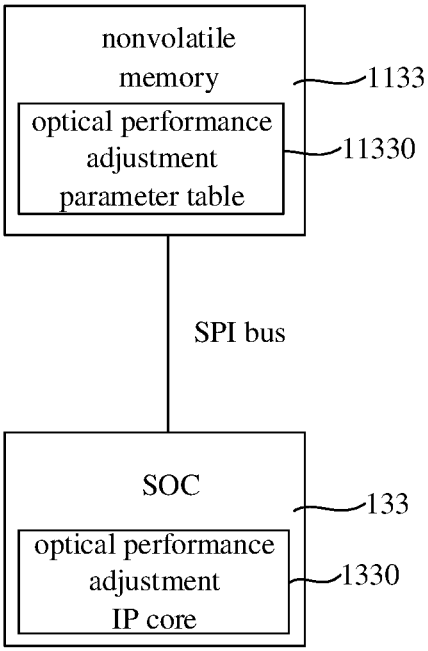
FIG. 4 is a schematic view of internal modules of the system-on-chip (SOC) and the nonvolatile memory disposed on the X-board in the display device shown in FIG. 1.

In addition, the nonvolatile memory 1133 is electrically connected to the connector CN1. As shown in FIG. 4, the nonvolatile memory 1133 stores an optical performance adjustment parameter table 11330. Parameters contained in the optical performance adjustment parameter table 11330 are parameters strongly related to the optical performance (also referred to as optical characteristics) of the display panel 111. In this embodiment, the nonvolatile memory 1133 is a SPI interface flash, and accordingly, the connector CN1 includes SPI bus interface.

The system board 13 is provided with a connector CN2, a system-on-chip 133 and a power management circuit 135. The connector CN2 of the system board 13 is connected to the connector CN1 of the circuit sub-board 113*a* through the connecting part CL1. Further, the system-on-chip 133 is electrically connected to the connector CN2 and has an optical performance adjustment intellectual property (IP) core 1330 as shown in FIG. 4, so that the system-on-chip 133 can read the optical performance adjustment parameter table 11330 stored in the nonvolatile memory of the circuit sub-board 113*a* by serial communication through the connector CN2, the connecting part CL1 and the connector CN1, and load it into the optical performance adjustment IP core 1330 to adjust the optical performance of the display panel 111. In addition, the connecting part CL1 is, for example, a single flexible cable (FFC). In addition, it is worth mentioning that the system board 13 of the embodiment is typically provided with a plurality of audio and video input interfaces, such as a CVBS interface, a HDMI interface, etc; The system board 13, also known as the mainboard, is used to decode video and audio signals input through the audio and video input interface, and then output the video signal to the X-board in digital signal format.

Figure 5:
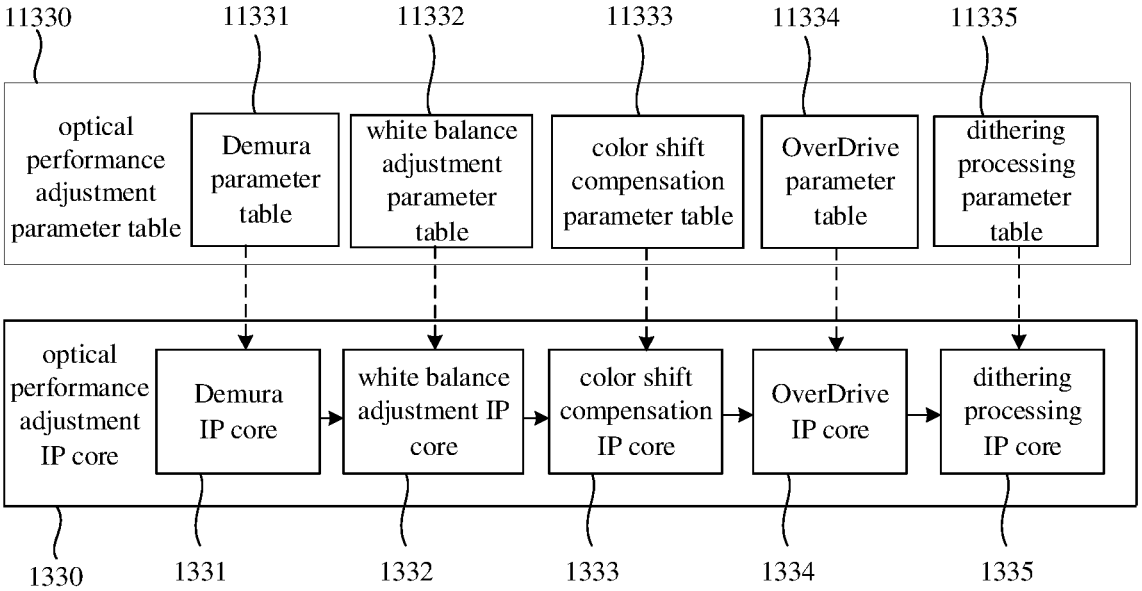
FIG. 5 is a schematic view of specific configurations of the optical performance adjustment parameter table and the optical performance adjustment IP core shown in FIG. 4.

As shown in FIG. 5, the optical performance adjustment IP core 1330 includes: a Demura IP core 1331, a white balance adjustment (also referred to as white tracking adjustment) IP core 1332, a color shift compensation IP core 1333, an OverDrive IP core 1334 and a dithering processing IP core 1335; correspondingly, the optical performance adjustment parameter table 11330 includes a Demura parameter table 11331, a white balance adjustment parameter table 11331, a color shift compensation parameter table 11333, an OverDrive parameter table 11334 and a dithering processing parameter table 11335. More specifically, the Demura IP core 1331 is configured for performing Mura (i.e., a phenomenon of various traces caused by uneven display brightness) elimination (also referred to as Demura) operation according to the Demura parameter table 11331. The white balance adjustment IP core 1332 is configured for performing white balance adjustment operation according to the white balance adjustment parameter table 11332. The color shift compensation IP core 1333 is configured for performing color shift compensation operation according to the color shift compensation parameter table 11333 to make the display panel 111 achieve low color shift display quality. The OverDrive IP core 1334 is configured for performing overvoltage driving (also referred to as OverDrive) operation according to the OverDrive parameter table 11334. The dithering processing IP core 1335 is configured for performing dithering processing operation such as temporal dithering and/or spatial dithering according to the dithering processing parameter table 11335. The parameters required for the Mura elimination operation, the white balance adjustment operation, the color shift compensation operation, the overvoltage driving operation and the dithering processing operation are known mature technologies, so they will not be repeated here. As for the power management circuit 135, it is electrically connected to the connector CN2 to provide the input DC voltage, such as 12V, to the circuit sub-board 113*a*; Further, the power management circuit 135 uses, for example, a mature PMIC (Power Management IC).

It is worth mentioning that according to the experimental verification of the applicant, the system-on-chip 133 is configured to sequentially control the Demura IP core 1331, the white balance adjustment IP core 1332, the color shift compensation IP core 1333, the OverDrive IP core 1334 and the dithering processing IP core 1335 to perform Demura operation, white balance adjustment, color shift compensation operation, OverDrive operation and dithering processing operation according to the Mura elimination parameter table 11331, the white balance adjustment parameter table 11332, the color shift compensation parameter table 11333, the OverDrive parameter table 11334 and the dithering processing parameter table 11335 respectively. This specific optical performance adjustment sequence makes it easier for the display panel 111 to achieve better display quality and optical taste.

In addition, it is worth noting that in other embodiments, the optical performance adjustment IP core 1330 can also include one or more selected from the group consisting of the Demura IP core 1331, the white balance adjustment IP core 1332, the color shift compensation IP core 1333, the OverDrive IP core 1334 and the dithering processing IP core 1335; Similarly, the optical performance adjustment parameter table 11330 can include one or more selected from the group consisting of the Mura elimination parameter table 11331, the white balance adjustment parameter table 11332, the color shift compensation parameter table 11333, the OverDrive parameter table 11334 and the dithering processing parameter table 11335 respectively.

The optical performance adjustment parameters (also referred to as optical codes) of the embodiment stored in the nonvolatile memory 1133 of the circuit sub-board 113*a* in the form of the parameter table, and debugging of each parameter in the optical performance adjustment parameter table is changed from the whole machine manufacturer to the panel manufacturer; because the optical performance adjustment parameters are strongly related to the panel, the optical performance adjustment parameter tables required for different panels are different, and the panel manufacturers know more about the optical characteristics of their own panels. Therefore, they can flexibly adjust the panel optical characteristics according to their own panel characteristics, which can liberate the whole machine manufacturers from the tedious work of adjusting optical characteristics, so as to accelerate the development speed of the whole machine.

In addition, it can be understood that the foregoing embodiments are only exemplary descriptions of the invention. On the premise that the technical features do not conflict, the structure does not conflict and does not violate the purpose of the invention, the technical solutions of the embodiments can be combined and used arbitrarily. Further, it can be understood that the signal conversion circuit 11312, the DC voltage conversion circuit 11314, the level conversion circuit 11316 and the Gamma correction circuit 11318 of the display control circuit 1131 in the foregoing embodiments are not limited to being distributed on a single circuit sub-board 113*a*, but can also be distributed on a plurality of driving circuit boards, such as circuit sub-boards 113*a* and 113*b* in FIG. 1.

The above display devices can be: LTPO (Low Temperature Polycrystalline Oxide) display device, Micro LED display device, liquid crystal panel, electronic paper, OLED (Organic Light-Emitting Diode) panel, AMOLED (Active-Matrix Organic Light Emitting Diode) panel, mobile phone, tablet computer, TV, display, notebook computer, digital photo frame and other products or components with display function.

In the several embodiments provided by the invention, it should be understood that the illustrated system, device, and method may be implemented in other manners. For example, the embodiments of device described above are merely illustrative, for example, the division of units is only a logical function division, and in actual implementations there may be another division manner, for example, multiple units or components may be combined or integrated into another system, or some features can be ignored or not executed. In addition, the coupling or direct coupling or communication connection as illustrated may be an indirect coupling or communication connection through some interfaces, devices or units, and further may be in an electrical, mechanical or other form.

The units described as separate components may be or may not be physically separated, and the components illustrated as units may be or may not be physical units, that is, may be located in one place, or may be distributed to multiple network units. Some or all of the units may be selected according to actual needs to achieve the purposes of the solutions of the embodiments.

In addition, each functional unit in each embodiment of the invention may be integrated into one processing unit, or each unit may be physically separated, or two or more units may be integrated into one unit. The above integrated unit can be implemented in a form of hardware or in a form of hardware with a software functional unit(s).

The above integrated unit implemented in the form of the software functional unit(s) can be stored in a computer readable storage medium. The above software functional unit(s) is/are stored in a storage medium and include(s) several instructions for causing a computer device (which may be a personal computer, a server, or a network device, etc.) to perform some of the steps of various embodiments of the invention. The foregoing storage medium may be a U-disk, a mobile hard disk, a read-only memory (ROM), a random-access memory (RAM), a magnetic disk, or an optical disk, which can store program codes.

The above is a further detailed description of the invention in combination with concrete preferred embodiments, and it cannot be determined that the concrete implementation of the invention is limited to these descriptions. For ordinary technicians in the technical field to which the invention belongs, several simple deduction or replacement can be made without departing from the concept of the invention, which shall be deemed to belong to the protection scope of the invention.

What is claimed is:

1. A display device, comprising:

a display panel, disposed with a gate driving circuit and a source driving circuit;

a horizontal direction circuit board (X-board), disposed with a driving circuit board assembly; wherein the driving circuit board assembly comprises a display control circuit and a first connector, and the display control circuit is connected with the gate driving circuit, the source driving circuit and the first connector;

a system board, disposed with a second connector and a system-on-chip connected to the second connector; wherein the system-on-chip comprises an optical performance adjustment intellectual property (IP) core; and a connecting part, connected between the first connector and the second connector.

2. The display device according to claim 1, wherein the X-board comprises at least two circuit sub-boards juxtaposed with each other, the driving circuit board assembly is disposed on one of the at least two circuit sub-boards, and adjacent two circuit sub-boards of the at least two circuit sub-boards form an electrical connection through another connecting part connected between connectors respectively disposed on the adjacent two circuit sub-boards.

3. The display device according to claim 1, wherein the X-board is further disposed with a plurality of mini low voltage differential signaling (Mini-LVDS) interfaces, the first connector comprises a point-to-point (P2P) interface, and the display control circuit comprises a signal conversion circuit; and wherein the signal conversion circuit is electrically connected to the first connector and the plurality of Mini-LVDS interfaces, and configured to receive a P2P interface signal containing image data through the first connector, generate source control signals and second interface type image data signals according to the P2P interface signal, and output the source control signals and the second interface type image data signals to the source driving circuit through the plurality of Mini-LVDS interfaces; and the second interface type image data signals are Mini-LVDS interface signals.

4. The display device according to claim 3, wherein the display control circuit further comprises a level conversion circuit and a direct-current (DC) voltage conversion circuit;

wherein the DC voltage conversion circuit is electrically connected to the first connector, and configured to receive an input DC voltage through the first connector, generate gate switching voltages according to the input DC voltage, and output the gate switching voltages to the level conversion circuit; and wherein the level conversion circuit is electrically connected to the first connector, and configured to receive reference timing signals through the first connector, generate gate control signals according to the reference timing signals and the gate switching voltages, and output the gate control signals to the gate driving circuit.

5. The display device according to claim 4, wherein an integration manner of the DC voltage conversion circuit, the level conversion circuit and the signal conversion circuit is one selected from the group consisting of:

the DC voltage conversion circuit, the level conversion circuit and the signal conversion circuit are integrated into a same chip;

the DC voltage conversion circuit and the level conversion circuit are integrated into a same chip, and the signal conversion circuit is integrated into another chip;

the DC voltage conversion circuit and the signal conversion circuit are integrated into a same chip, and the level conversion circuit is integrated into another chip;

the level conversion circuit and the signal conversion circuit are integrated into a same chip, and the DC voltage conversion circuit is integrated into another chip; and the DC voltage conversion circuit, the level conversion circuit and the signal conversion circuit are respectively integrated into different chips.

6. The display device according to claim 3, wherein the display control circuit further comprises a level conversion circuit, a DC voltage conversion circuit and a Gamma correction circuit;

wherein the DC voltage conversion circuit is electrically connected to the first connector, and configured to receive an input DC voltage through the first connector, generate gate switching voltages and a reference voltage according to the input DC voltage, and output the gate switching voltages and the reference voltage to the level conversion circuit and the Gamma correction circuit respectively;

wherein the level conversion circuit is electrically connected to the first connector, and configured to receive reference timing signals through the first connector, generate gate control signals according to the reference timing signals and the gate switching voltages, and output the gate control signals to the gate driving circuit; and wherein the Gamma correction circuit is configured to generate a plurality of Gamma voltages according to the reference voltage and output the plurality of Gamma voltages to the source driving circuit.

7. The display device according to claim 1, wherein the X-board is further disposed with a nonvolatile memory electrically connected to the first connector;

wherein the nonvolatile memory stores an optical performance adjustment parameter table; and wherein the system-on-chip is configured to read the optical performance adjustment parameter table stored in the nonvolatile memory through the second connector, the connecting part and the first connector and load the optical performance adjustment parameter table into the optical performance adjustment IP core.

8. The display device according to claim 7, wherein the optical performance adjustment IP core comprises one or more selected from the group consisting of a Demura IP core, a white balance adjustment IP core, a color shift compensation IP core, an OverDrive IP core and a dithering processing IP core; and wherein the optical performance adjustment parameter table correspondingly comprises one or more selected from the group consisting of a Demura parameter table, a white balance adjustment parameter table, a color shift compensation parameter table, an OverDrive parameter table and a dithering processing parameter table.

9. The display device according to claim 8, wherein the optical performance adjustment IP core comprises the Demura IP core, the white balance adjustment IP core, the color shift compensation IP core, the OverDrive IP core and the dithering processing IP core; and the system-on-chip is configured to sequentially control the Demura IP core, the white balance adjustment IP core, the color shift compensation IP core, the OverDrive IP core and the dithering processing IP core to perform a Demura operation, a white balance adjustment, a color shift compensation operation, an OverDrive operation and a dithering processing operation according to the Demura parameter table, the white balance adjustment parameter table, the color shift compensation parameter table, the OverDrive parameter table and the dithering processing parameter table respectively.

* * * * *